US007619186B2

(12) United States Patent
Cavada et al.

(10) Patent No.: US 7,619,186 B2
(45) Date of Patent: Nov. 17, 2009

(54) INTELLIGENT USER INTERFACE FOR MULTI-PURPOSE OVEN USING INFRARED HEATING FOR REDUCED COOKING TIME

(75) Inventors: Luis Cavada, Miami, FL (US); Alvaro Vallejo, Querétaro (MX); Victoria Vilbrandt, Hollywood, FL (US)

(73) Assignee: Applica Consumer Products, Inc., Miramar, FL (US)

( * ) Notice: Subject to any disclaimer, the term of this patent is extended or adjusted under 35 U.S.C. 154(b) by 0 days.

(21) Appl. No.: 11/319,050

(22) Filed: Dec. 27, 2005

(65) Prior Publication Data

US 2006/0157470 A1 Jul. 20, 2006

Related U.S. Application Data

(63) Continuation-in-part of application No. 10/776,028, filed on Feb. 10, 2004, now Pat. No. 7,323,663, and a continuation-in-part of application No. 10/815,098, filed on Mar. 31, 2004, now abandoned.

(51) Int. Cl.
*H05B 1/02* (2006.01)

(52) U.S. Cl. ..... 219/506; 219/412; 219/483; 219/497; 219/720; 99/325

(58) Field of Classification Search ..... 219/506, 219/501, 497, 412–415, 720, 713, 714, 680, 219/494; 99/325–333
See application file for complete search history.

(56) References Cited

U.S. PATENT DOCUMENTS 3,472,153 A 10/1969 Arntz ..... 99/329
3,604,338 A 9/1971 Fiedler ..... 99/339

(Continued)

FOREIGN PATENT DOCUMENTS

EP 0696430 A1 2/1996
JP 2000055376 A 2/2000

OTHER PUBLICATIONS

Computer Generated Translation of JP2000055376A; provided by Examiner in Jan. 29, 2007 Office Action of U.S. Appl. No. 10/776,028 (with Examiner notes); 6 pages, Jan. 10, 2007.

(Continued)

*Primary Examiner*—Mark H Paschall
(74) *Attorney, Agent, or Firm*—King & Spalding L.L.P.

(57) ABSTRACT

An intelligent user interface for the selection of predefined cooking profiles for a number of different foods to be cooked in a multi-purpose oven using infrared heating. When a food has not been predefined for cooking in the infrared multi-purpose oven, procedures used for conventional cooking technologies may converted to for use by the multi-purpose oven so as to obtain substantially the same cooking results for the desired food. The intelligent user interface may have menus of different foods for programming cooking profiles for the infrared multi-purpose oven. Predefined "hot buttons" may be used for quick selection of a cooking profile for a desired food (e.g., common foods such as popcorn, pizza rolls, chicken wings, oven fries, and other prepared and frozen foods), and/or a menu screen may be scrolled through to select a cooking profile for the desired food.

50 Claims, 8 Drawing Sheets

U.S. PATENT DOCUMENTS 3,626,154 A 12/1971 Reed ..... 219/411
3,646,879 A 3/1972 Palmason et al. ..... 99/339
3,663,798 A 5/1972 Speidel et al. ..... 219/464
3,668,371 A 6/1972 Fry et al. ..... 219/413
3,736,860 A 6/1973 Vischer, Jr. ..... 99/339
3,941,044 A 3/1976 Goltsos ..... 99/391
3,978,238 A 8/1976 Frey et al. ..... 426/523
4,093,841 A 6/1978 Dills ..... 219/10.55
4,135,077 A 1/1979 Wills
4,150,609 A 4/1979 McClean ..... 99/372
4,164,644 A 8/1979 Remsnyder et al. ..... 219/433
4,345,143 A 8/1982 Craig et al. ..... 219/411
4,421,015 A 12/1983 Masters et al. ..... 99/332
4,441,002 A * 4/1984 Teich et al. ..... 219/708
4,481,404 A 11/1984 Thomas et al. ..... 219/398
4,489,234 A 12/1984 Harnden, Jr. et al. ..... 219/347
4,491,066 A 1/1985 Juriga et al. ..... 99/391
4,516,486 A 5/1985 Burkhart ..... 99/388
4,551,616 A 11/1985 Buttery ..... 219/460
4,554,437 A 11/1985 Wagner et al. ..... 219/388
4,575,616 A 3/1986 Bergendal ..... 219/405
4,577,092 A 3/1986 Lenoir ..... 219/354
4,580,025 A 4/1986 Carlson et al. ..... 219/10.55
4,602,143 A 7/1986 Mack et al. ..... 219/225
4,664,923 A 5/1987 Wagner et al. ..... 426/233
4,728,777 A 3/1988 Tsisios et al. ..... 219/348
4,761,529 A 8/1988 Tsisios ..... 219/10.55
4,791,862 A 12/1988 Hoffmann ..... 99/385
4,889,042 A 12/1989 Hantz et al. ..... 99/340
4,960,977 A 10/1990 Alden ..... 219/388
4,965,434 A 10/1990 Nomura et al. ..... 392/407
4,972,768 A 11/1990 Basora San Juan ..... 99/391
5,033,366 A 7/1991 Sullivan ..... 99/352
5,036,179 A 7/1991 Westerberg et al. ..... 219/411
5,126,534 A 6/1992 Kwong ..... 219/386
5,157,239 A 10/1992 Kanaya et al. ..... 219/411
5,181,455 A 1/1993 Masel et al. ..... 99/391
5,223,290 A 6/1993 Alden ..... 426/243
5,237,913 A 8/1993 Hahnewald et al. ..... 94/389
5,266,766 A 11/1993 Hecox ..... 219/10.81
5,317,134 A 5/1994 Edamura ..... 219/720
5,363,748 A 11/1994 Boehm et al. ..... 99/372
5,378,872 A 1/1995 Jovanovic ..... 219/388
5,382,441 A 1/1995 Lentz et al. ..... 426/241
5,390,588 A 2/1995 Krasznai et al. ..... 99/389
5,400,697 A 3/1995 Dax et al. ..... 99/389
5,404,420 A 4/1995 Song ..... 392/416
5,471,914 A 12/1995 Krasznai et al. ..... 99/389
5,472,721 A 12/1995 Eisenberg et al. ..... 426/243
5,499,574 A 3/1996 Esposito ..... 99/339
5,517,005 A 5/1996 Westerberg et al. ..... 219/685
5,560,285 A 10/1996 Moreth ..... 99/421 H
5,590,584 A 1/1997 Ahn ..... 99/327
5,606,905 A 3/1997 Boehm et al. ..... 99/375
5,647,270 A 7/1997 Rousseau et al. ..... 99/327
5,653,158 A 8/1997 Balandier et al. ..... 99/327
5,676,870 A 10/1997 Wassman et al. ..... 219/400
5,692,432 A 12/1997 Hazan et al. ..... 99/328
5,726,423 A 3/1998 Westerberg et al. ..... 219/411
5,771,780 A 6/1998 Basora et al. ..... 99/327
5,793,019 A 8/1998 Boyle et al. ..... 219/400
5,809,994 A 9/1998 Maher, Jr. ..... 126/374
5,823,099 A 10/1998 Ko ..... 99/446
5,877,477 A 3/1999 Petty et al. ..... 219/506
5,905,269 A 5/1999 Venkataramini et al. 250/504 R
5,909,533 A 6/1999 Kitabayashi et al. ..... 392/310
5,924,355 A 7/1999 Belknap et al. ..... 99/389
5,947,006 A 9/1999 Mauffrey ..... 99/327
5,958,271 A 9/1999 Westerberg et al. ..... 219/413
5,960,702 A 10/1999 Thiriat et al. ..... 99/327
5,990,454 A 11/1999 Westerberg et al. ..... 219/411
6,011,242 A 1/2000 Westerberg ..... 219/411
6,013,900 A 1/2000 Westerberg et al. ..... 219/405
6,013,908 A 1/2000 Kume et al. ..... 219/719
6,018,146 A 1/2000 Uzgiris et al. ..... 219/405
6,057,528 A 5/2000 Cook ..... 219/405
6,062,128 A 5/2000 Borgward ..... 99/326
6,069,345 A * 5/2000 Westerberg ..... 219/411
RE36,724 E 6/2000 Westerberg et al. ..... 219/685
6,097,016 A * 8/2000 Hirata et al. ..... 219/720
6,146,677 A 11/2000 Moreth ..... 426/505
6,172,347 B1 1/2001 Lee ..... 219/685
6,201,217 B1 3/2001 Moon et al. ..... 219/386
6,229,117 B1 5/2001 Lenahan ..... 219/411
6,250,210 B1 6/2001 Moreth ..... 99/331
6,294,769 B1 9/2001 McCarter ..... 219/544
6,297,481 B1 10/2001 Gordon ..... 219/406
6,297,485 B1 10/2001 Kim et al. ..... 219/680
6,307,185 B1 10/2001 Loveless ..... 219/400
6,311,608 B1 11/2001 Hardin et al. ..... 99/326
6,316,757 B1 11/2001 Kim et al. ..... 219/680
6,320,165 B1 11/2001 Ovadia ..... 219/400
6,348,676 B2 2/2002 Kim et al. ..... 219/411
6,369,360 B1 4/2002 Cook ..... 219/388
6,369,366 B1 4/2002 Mullen ..... 219/450.1
6,382,084 B2 5/2002 Chan et al. ..... 99/327
6,405,640 B1 6/2002 Moreth ..... 99/334
6,408,842 B1 6/2002 Herrera ..... 126/41 C
6,415,710 B1 7/2002 Boone ..... 99/446
6,429,409 B1 8/2002 Siu ..... 219/450.1
6,448,540 B1 9/2002 Braunisch et al. ..... 219/685
6,486,453 B1 11/2002 Bales et al. ..... 219/702
6,528,772 B1 * 3/2003 Graves et al. ..... 219/680
6,530,309 B2 3/2003 Van Der Meer et al. ..... 99/331
6,649,877 B1 11/2003 Mauffrey et al. ..... 219/386
6,654,549 B1 11/2003 Konishi ..... 392/407
6,670,586 B2 12/2003 Ingemanson et al. ..... 219/492
6,707,011 B2 3/2004 Tay et al. ..... 219/411
6,717,110 B2 4/2004 Van der Meer et al. ..... 219/386
6,867,399 B2 * 3/2005 Muegge et al. ..... 219/681
6,933,477 B2 8/2005 Becker et al. ..... 219/506
6,964,222 B1 11/2005 Tucker ..... 99/281
7,013,798 B2 3/2006 Anedo et al. ..... 99/326
7,109,442 B2 9/2006 Steinberg et al. ..... 219/386
2002/0092842 A1 7/2002 Loveless ..... 219/400
2002/0096984 A1 7/2002 Konishi et al. ..... 313/25
2002/0144995 A1 * 10/2002 Chun ..... 219/720
2002/0148824 A1 10/2002 Hauf et al. ..... 219/411
2003/0121904 A1 * 7/2003 Ingemanson et al. ..... 219/492
2004/0131493 A1 7/2004 Hattendorf et al. ..... 420/62
2004/0134900 A1 7/2004 Chun ..... 219/702
2005/0005776 A1 1/2005 Steinberg et al. ..... 99/331
2005/0005777 A1 1/2005 Steinberg et al. ..... 99/349
2005/0136785 A1 6/2005 Konishi et al. ..... 445/27
2005/0173400 A1 8/2005 Cavada et al. ..... 219/411
2005/0218139 A1 10/2005 Cavada et al. ..... 219/720
2005/0247210 A1 11/2005 Ragan ..... 99/372

OTHER PUBLICATIONS

New High Temperature Quartz Heater Provides Efficiency, Economy, Watlow Electric Manufacturing Company, 3 pages, 2001.
Toaster Oven Instruction Manuel, www.krups.com, Krups USA 196 Boston Ave., Medford, MA 02155, 16 pages, 2004.
Appliance Heating Alloys, Kanthal Handbook, The Kanthal Corporation, pp. 4-38, 1997.
Toastmaster® Dealer Price List, Jan. 1, 2003, 1 page.
Toastmaster® Spring Program 2003, 1 page, 2003.
George Foreman, The Next Grilleration Model No. GRP99 Owner's Manual, Salton, Inc., pp. 1-12, 2004.
Lightwave Oven, Use and Care Guide and Recipe Book Models TLWTOB6 and TLWTOB6CAN, Toastmaster, 27 pages, 2004.

* cited by examiner

FIG. 1
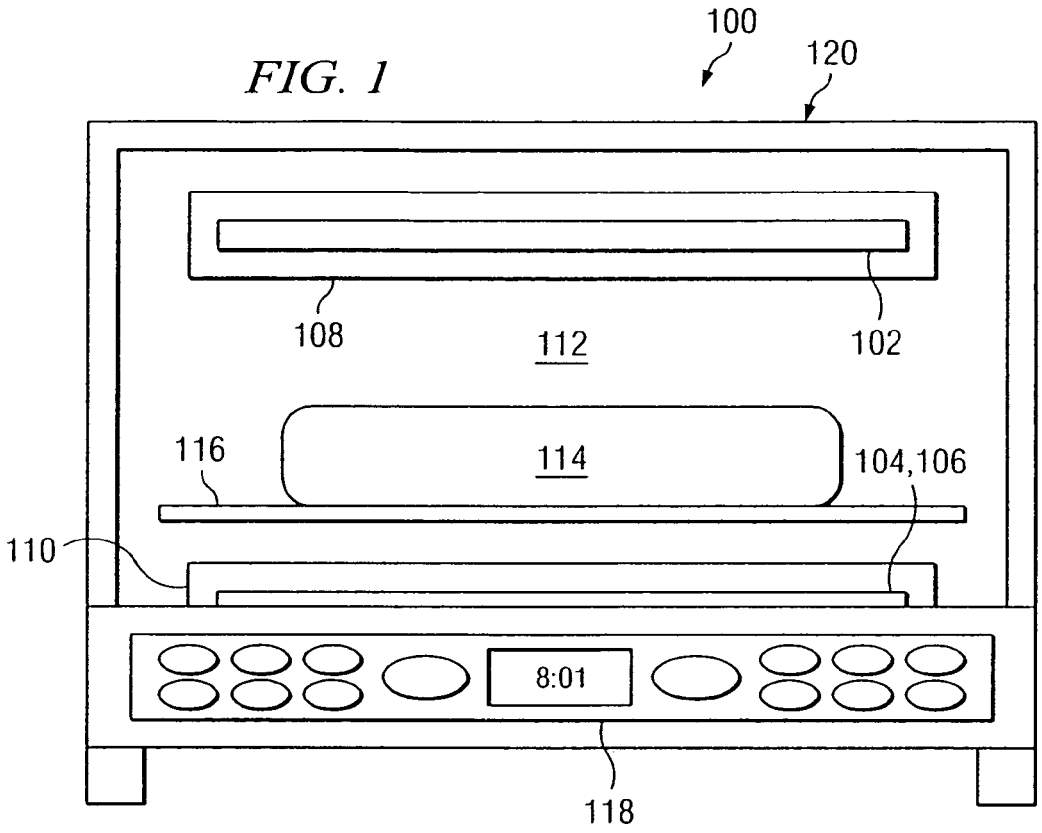
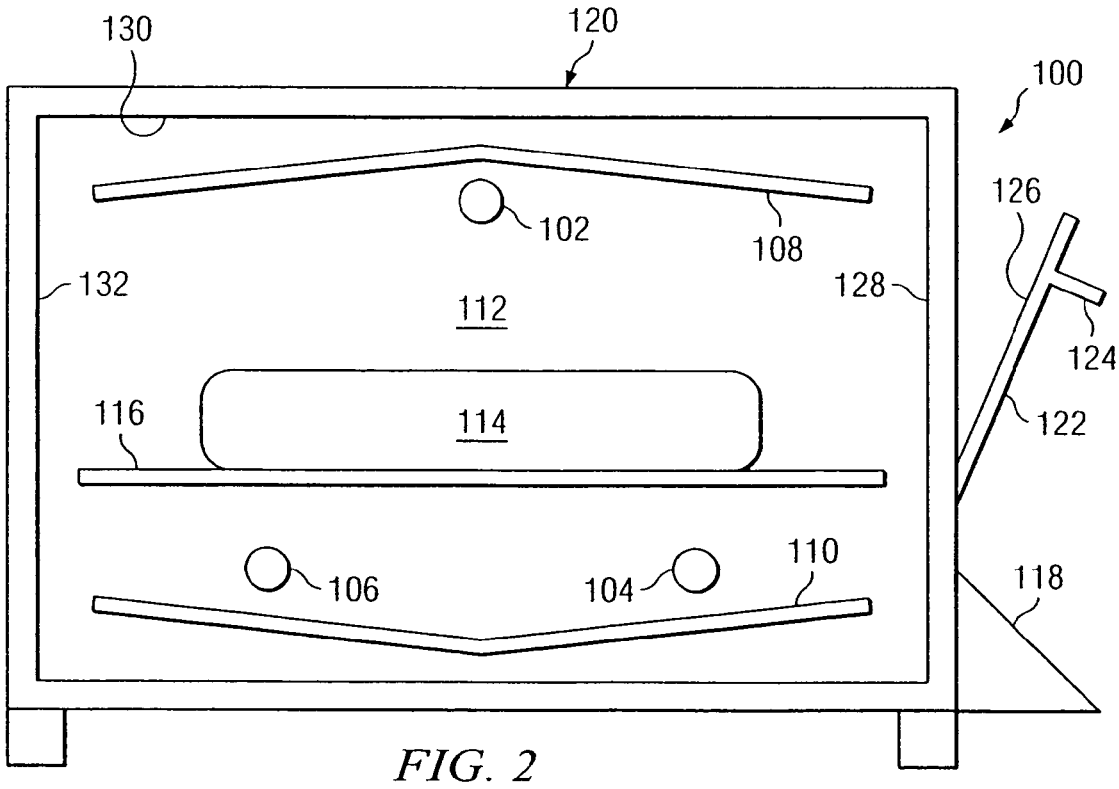
FIG. 2

| BUTTON | CHOICE (UP/DOWN BUTTONS) | SECOND CHOICE | CYCLE (SECONDS) T&B | B | OFF | DEFAULT DURATION (MINUTES) |
|---|---|---|---|---|---|---|
| QUICK FOODS | FROZEN, REFRIGERATED OR HOMEMADE CHIX NUGGETS | | 25 | 10 | 0 | 8 |
| | FROZEN PIZZA ROLLS | | 25 | 10 | 0 | 6 |
| | FROZEN POTATO SKINS | | 25 | 10 | 0 | 5 |
| | FROZEN POPPERS | | 25 | 10 | 0 | 8 |
| | FROZEN CHICKEN WINGS | | 25 | 10 | 0 | 10 |
| | FROZEN BAGEL BITES | | 25 | 10 | 0 | 7 |
| | FROZEN POTATO CRISPERS | | 25 | 10 | 0 | 9 |
| | FROZEN OVEN FRIES | | 25 | 10 | 0 | 10 |
| COOKIES | ALL TYPES | | 13 | 15 | 20 | 7 |
| PIZZA | REGULAR | | 20 | 5 | 10 | 11 |
| | RISING CRUST | | 15 | 20 | 20 | 15 |
| | FRENCH BREAD | | 15 | 20 | 20 | 12 |
| | FRESH, HOMEMADE OR DELI | | 15 | 20 | 20 | 15 |
| REHEAT | PIZZA SLICE | | 15 | 25 | 20 | 5 |
| | SEVERAL PIZZA SLICES | | 15 | 25 | 20 | 7 |
| | RIBS | | 15 | 25 | 20 | 20 |
| | CHICKEN PIECES | | 20 | 20 | 10 | 18 |
| | CASSEROLES | | 15 | 25 | 20 | 20 |

*FIG. 7*

| BUTTON | CHOICE (UP/DOWN BUTTONS) | SECOND CHOICE | CYCLE (SECONDS) T&B | B | OFF | DEFAULT DURATION (MINUTES) |
|---|---|---|---|---|---|---|
| BAKE/ROAST | LAYER CAKE, YELLOW | | 8 | 18 | 20 | 23 |
| | LAYER CAKE, CHOCOLATE | | 8 | 18 | 20 | 30 |
| | CUPCAKES, YELLOW | | 8 | 18 | 20 | 15 |
| | CUPCAKES, CHOCOLATE | | 8 | 18 | 20 | 18 |
| | MUFFINS | | 15 | 15 | 15 | 8 |
| | COFFEECAKE | | 8 | 18 | 20 | 27 |
| | BROWNIES | | 10 | 15 | 20 | 27 |
| | BAR COOKIES | | 8 | 18 | 20 | 20 |
| | BAKING POTATOES | | 30 | 30 | 0 | 35 |
| | SINGLE PIE CRUST (BAKED BLIND) | | 30 | 30 | 0 | 7 |
| | 2-CRUST PIE | | 15 | 15 | 15 | 28 |
| | REFRIGERATOR BISCUITS | | 15 | 15 | 15 | 10 |
| | HOMEMADE BISCUITS | | 15 | 15 | 15 | 11 |
| | REFRIGERATOR CRESCENT ROLLS | | 13 | 15 | 20 | 12 |
| | FROZEN BISCUITS | | 13 | 15 | 15 | 15 |
| | CASSEROLES | | 20 | 30 | 0 | 22 |
| | LASAGNA | | 20 | 30 | 0 | 40 |
| | CHICKEN | | | | | |
| | | WHOLE CHICKEN | 20 | 30 | 0 | 40 |
| | | CHICKEN PARTS | 20 | 30 | 0 | 35 |
| | | CHICKEN BREAST | 20 | 30 | 0 | 30 |
| | TURKEY | | | | | |
| | | HALF TURKEY BREAST | 20 | 30 | 0 | 60 |
| | | FROZEN TURKEY BREAST ROLL | 20 | 30 | 0 | 60 |

TO FIG. 8B

FIG. 8A

FROM FIG. 8A

| | | | | | | |
|---|---|---|---|---|---|---|
| | MEATLOAF (1 1/2 POUNDS) | | 20 | 30 | 0 | 45 |
| | BEEF | | 20 | 30 | 0 | 20 |
| | RIB ROAST, (2 3/4 POUNDS) | | 20 | 30 | 0 | 40 |
| BROIL | HIGH | | | | | |
| | | PORK LOIN RIB CHOPS | ON | ON | | 20 |
| | | BEEF STEAKS | ON | ON | | 16 |
| | | HOT DOGS | ON | ON | | 10 |
| | | BURGERS (FRESH, FROZEN, BEEF, TURKEY, VEGGIE) | ON | ON | | 14 |
| | LOW | | | | | |
| | | CHICKEN PARTS | 30 | 30 | | 30 |
| CONVERTMENU | MEAT | | 20 | 30 | 0 | 20 |
| | FISH | | 20 | 30 | 0 | 10 |
| | POULTRY | | 20 | 30 | 0 | 30 |
| | DESSERT | | 13 | 15 | 20 | 10 |
| | BAKED GOODS | | 13 | 15 | 15 | 10 |
| | CASSEROLE | | 20 | 30 | 0 | 20 |
| SPEED TOAST | 1 | | XX | | | N/A |
| | 2 | | XX | | | N/A |
| | 3 | | XX | | | N/A |
| | 4 | | XX | | | N/A |
| | 5 | | XX | | | N/A |
| | 6 | | XX | | | N/A |
| | 7 | | XX | | | N/A |

| PACKAGE TEMP | "A" VALUE |
|---|---|
| BELOW 300 | 0.85 |
| 300 | 0.9 |
| 325 | 0.95 |
| 350 | 1 |
| 375 | 1.05 |
| 400 | 1.1 |
| 425 | 1.15 |
| OVER 425 | 1.15 |

IR TIME=((PACKAGE TIME*0.51)+2.0)*A
IR TIME=((PACKAGE TIME*0.51)+3.5)*A
IR TIME=((PACKAGE TIME*0.51)+3.5)*A
IR TIME=((PACKAGE TIME*0.51)+1)*A
IR TIME=((PACKAGE TIME*0.51)+2)*A
IR TIME=((PACKAGE TIME*0.51)+3.5)*A

| COLD START | WARM START |
|---|---|
| 85 | 60 |
| 90 | 70 |
| 115 | 80 |
| 125 | 85 |
| 130 | 95 |
| 165 | 115 |
| 220 | 150 |

FIG. 8B

INTELLIGENT USER INTERFACE FOR MULTI-PURPOSE OVEN USING INFRARED HEATING FOR REDUCED COOKING TIME

RELATED PATENT APPLICATIONS

This patent application is a continuation-in-part application of and claims priority to commonly owned U.S. patent application Ser. No. 10/776,028, filed Feb. 10, 2004 now U.S. Pat. No. 7,323,663, entitled "Multi-Purpose Oven Using Infrared Heating For Reduced Cooking Time" by Luis Cavada and Alvaro Vallejo; and U.S. patent application Ser. No. 10/815,098, filed Mar. 31, 2004 now abandoned, entitled "Intelligent User Interface for New Cooking Technologies" by Luis Cavada, Alvaro Vallejo and Victoria Vilbrandt; wherein the aforementioned patent applications are hereby incorporated by reference herein for all purposes.

TECHNICAL FIELD

The present disclosure relates to selecting cooking parameters in the preparation of foods, and more specifically, selecting cooking parameters using an intelligent user interface to select the cooking parameters of a multi-purpose oven using infrared heating in the preparation of the foods.

BACKGROUND

Over the years there have been many attempts to introduce new cooking technologies that would allow faster cooking of foods. Products such as convection, microwave, and infrared ovens have been devised in order to try and speed up the cooking process. However the new cooking technologies caused consumers to guess how to properly cook foods, e.g., time, power used, etc. Guidelines were presented as to how to best cook using a new technology, but required much trial and error before satisfactory cooking results were obtained. Quite often the user was frustrated and took a long time to arrive at reasonable results.

With subsequent technology enhancements in the new cooking technology products, e.g., microwave ovens, these products began to include some pre-programmed functions, e.g., buttons for cooking popcorn, baked potatoes, and frozen foods. Unfortunately, these pre-programmed functions still fell short in meeting the user's expectations. With differing amounts of food to be cooked, these pre-programmed functions proved inadequate for all situations. Yet other new technologies provided a complex interface where the user was required to reply to multiple questions in order to approximate a cooking cycle. The resulting cooking cycle would be adjusted for the amount of food to be cooked. This was particularly important since the new cooking technologies were not able to cook varying amounts of food in the same time frame.

SUMMARY

Therefore a problem exists and a solution is needed for better and more consistent results when cooking foods with cooking technologies using infrared heating.

According to a specific example embodiment of this disclosure, an intelligent user interface may be used in selecting predefined infrared cooking profiles for cooking a number of different foods. When a food has not been predefined for the infrared cooking technology, procedures used for conventional cooking technologies may be converted to the desired infrared cooking technology procedures so as to obtain substantially the same cooking results for the desired food.

According to another specific example embodiment of this disclosure, selection from a menus of a plurality of different foods may be used for programming a infrared cooking profile for the selected food to be cooked. Profile parameters for infrared cooking may be empirically determined and/or extrapolated from profile parameters determined from cooking of similar foods. Predefined "hot buttons" may be used for quick selection of an infrared cooking profile for a desired food (e.g., common foods such as popcorn, pizza rolls, chicken wings, oven fries, and other prepared and frozen foods), and/or a menu screen may be scrolled through to select an infrared cooking profile for the desired food.

According to still another specific example embodiment of this disclosure, a user may simply define an infrared cooking profile using a familiar method, e.g., from a standard cookbook and/or prior experience, e.g., old family recipe, and then this familiar cooking profile may be converted to an equivalent cooking profile appropriate for the infrared cooking technology being used. The intelligent user interface may correlate standard instructions for cooking foods, e.g., in a conventional oven, to the necessary control and timing profiles for cooking the same food using the infrared oven. When the user desires to cook a food whose cooking profile has not been correlated to infrared cooking, the user may optionally select a custom menu option, e.g., convert-menu. The convert-menu may query the user for information that may be used for converting a conventional cooking profile for a food to an equivalent operating profile for cooking the food with the infrared oven. The user may be asked to enter the type of food, e.g., meat, fish, poultry, vegetables, pastry, pies, etc., and the conventional cooking temperature and time for that food. The type of food, and the conventional cooking temperature and time may then be used for converting to an equivalent operating profile for cooking the food with the infrared oven. Weight and/or thickness of the food also may used in the profile conversion process. Thus, the conversion process may use the conventional cooking parameters and type of food, optionally including weight and/or thickness to create an appropriate infrared cooking profile for that food.

BRIEF DESCRIPTION OF THE DRAWINGS

A more complete understanding of the present disclosure thereof may be acquired by referring to the following description taken in conjunction with the accompanying drawings wherein:

FIG. 1 is a schematic elevational front view of a multi-purpose oven using infrared heating, according to an example embodiment of this disclosure;

FIG. 2 is a schematic elevational side view of the multi-purpose oven illustrated in FIG. 1;

FIGS. 7, 8A and 8B are tables of cooking parameters of an intelligent user interface for a multi-purpose oven using infrared heating in the preparation of foods, according to an example embodiment of this disclosure.

Figure 3:
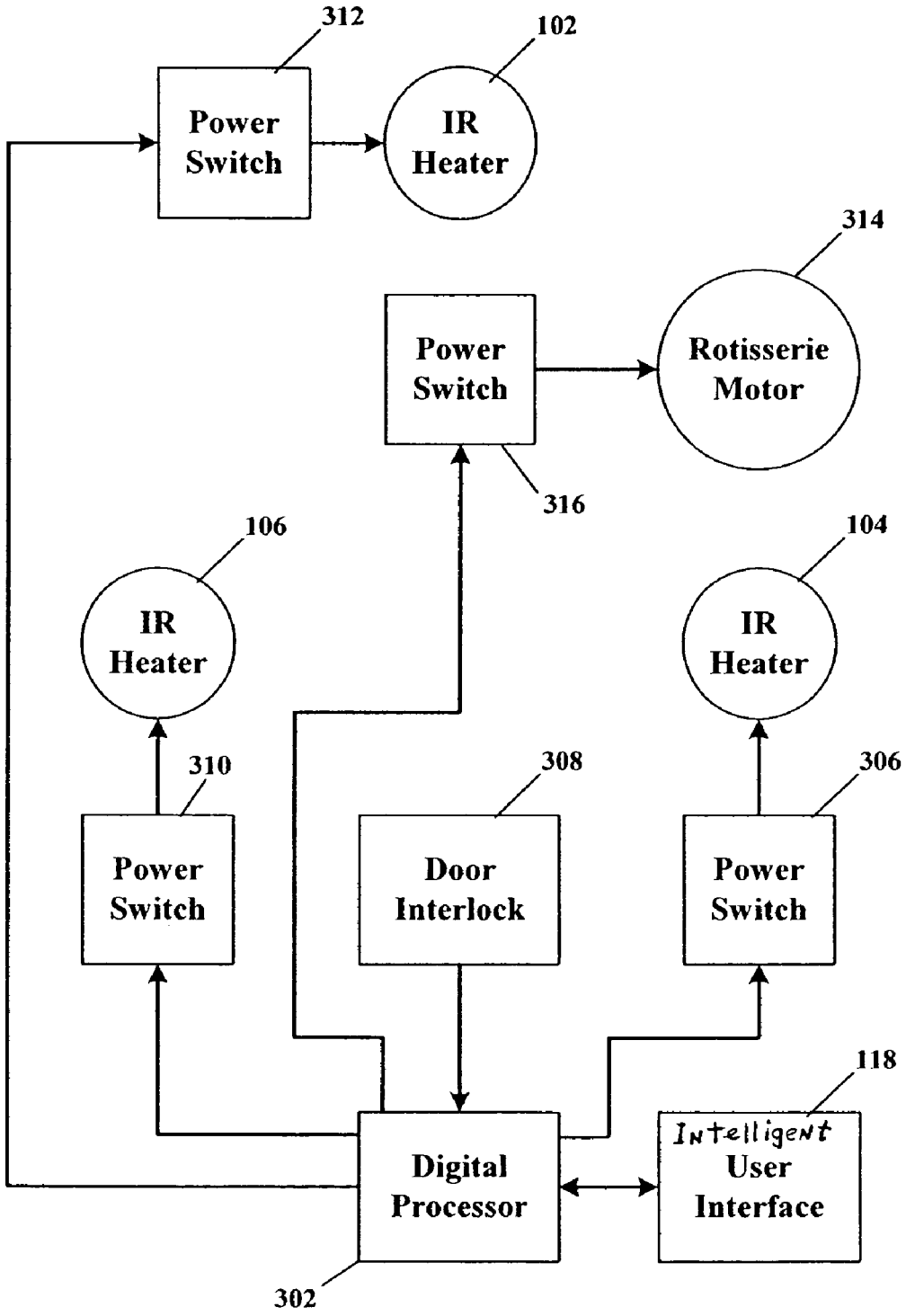
FIG. 3 is a schematic electrical block diagram of a multi-purpose oven having an intelligent user interface, according to an example embodiment of this disclosure.

While the present disclosure is susceptible to various modifications and alternative forms, specific example embodiments thereof have been shown in the drawings and are herein described in detail. It should be understood, however, that the description herein of specific example embodiments is not intended to limit the disclosure to the particular forms disclosed herein, but on the contrary, this disclosure is to cover all modifications and equivalents as defined by the appended claims.

DETAILED DESCRIPTION

Referring now to the drawings, the details of example embodiments are schematically illustrated. Like elements in the drawings will be represented by like numbers, and similar elements will be represented by like numbers with a different lower case letter suffix.

Referring now to FIGS. 1 and 2, depicted are schematic diagrams of elevational front and side views of a multi-purpose oven using infrared heating, according to an example embodiment of this disclosure. The multi-purpose oven, generally represented by the numeral 100, comprises a top infrared wavelength emitting radiant heat source (hereinafter top IR heater) 102, bottom infrared wavelength emitting radiant heat sources (hereinafter bottom IR heaters) 104 and 106, top radiant heat reflector 108, bottom radiant heat reflector 110, an oven chamber 112 adapted for cooking a food 114, food tray 116, a user interface 118, and an oven housing 120. A front door 122 (FIG. 2) is attached to the oven housing 120 and is adapted to be opened and closed, for example, by a handle 124 on the front upper portion of the door 122. The inner surfaces of the oven chamber 112, e.g., front wall 128, top wall 130, rear wall 132, interior surface of the door 122, and/or combinations thereof, may be coated with suitable material, e.g., porcelain, ceramic coatings, to re-radiate IR at a desired wavelength(s), e.g., longer or shorter IR wavelength, etc., and/or to achieve a desired operating effect, e.g., a "brick oven."

The top IR heater 102 is positioned so as to emit infrared radiant heat directly onto the surface of the food located in the oven chamber 112. The top radiant heat reflector 108 is preferably designed to evenly distribute reflected infrared radiant heat energy over the food 114 from the top IR heater 102. The top IR heater 102 may comprise one or more infrared radiant heat sources. The top IR heater 102 may have a peak emission at, for example but not limited to, a wavelength(s) of from about 1.63 microns to about 1.7 microns (1630-1700 nm).

The bottom IR heaters 104 and 106 are located below the food tray 116. The bottom radiant heat reflector 110 directs the infrared radiant heat energy into the food 114 from the bottom IR heaters 104 and 106. The bottom IR heaters 104 and 106 preferably emit longer infrared wavelengths then does the top IR heater 102. These longer infrared wavelengths have a deeper penetration in to the food during cooking. These longer infrared wavelengths may pass through the food tray 116 and/or be reflected from the bottom radiant heat reflector 110, and/or walls of the oven enclosure 120. The bottom IR heaters 104 and 106 may have a peak emission at, for example but not limited to, a wavelength(s) of from about 2.0 microns to about 2.2 microns (2000-2200 nm). The food tray 116 may be a wire screen, heat resistant glass or ceramic, a metal pan, a grilling plate having vertical ridges thereon (not shown), etc.

Both the top IR heater 102 and bottom IR heaters 104 and 106 may also radiate some infrared energy at some percentage of infrared wavelengths that are longer and/or shorter than the aforementioned nominal infrared wavelengths. In addition to the wavelengths of the directly emitted infrared energy, the wavelengths of the reflected infrared energy may be further elongated once they have been reflected off the walls of the oven cooking chamber 120 and the reflectors 108 and 110 therein. It is contemplated and within the scope of this disclosure that radiant heaters that emit longer infrared wavelengths may be incorporated for improved cooking performance when baking and/or broiling of foods.

The reflectors 108 and 110 are shaped so as to reflect the infrared radiant heat from the top IR heater 102 and the bottom IR heaters 104 and 106, respectively, onto the food in the oven chamber 112. The infrared radiant heat reflected from the reflectors 108 and 110 may be at a longer wavelength than the directly emitted infrared radiant heat from the top IR heater 102 and the bottom IR heaters 104 and 106, respectively. This longer wavelength infrared radiant heat penetrates deeper into the food, thus shortening the moisture evaporation time of the food before surface browning may occur. The wavelengths of infrared radiated heat may be from about 1 to about 3 microns, preferably from about 1.5 to about 2.5 microns, and most preferably at about 1.63 microns for the top IR heater 102 and about 2.11 microns for the bottom IR heaters 104 and 106.

The top IR heater 102, and bottom IR heaters 104 and 106 may be comprised of a filament (not shown) whereby electrical current is passed through the filament so as to heat the filament to a temperature at which a desired wavelength(s) of infrared energy is radiated therefrom. The top IR heater 102, and bottom IR heaters 104 and 106 may radiate a plurality of wavelengths of infrared energy as well as wavelengths of visible light. Material for and electrical current through the top IR heater 102, and bottom IR heaters 104 and 106 are selected so that the heaters produce predominantly the desired infrared wavelength or wavelengths for cooking the food. The filaments may be comprised of any type of material that can be used for resistance electric heating and is capable of emitting radiant heating energy at infrared wavelengths, e.g., metal alloy filament materials such as, for example but not limited to, Ni Fe, Ni Cr, Ni Cr Fe and Fe Cr Al, where the symbols: Ni represents nickel, Fe represents iron, Cr represents chromium, and Al represents aluminum. The filaments may be exposed or, preferably, enclosed within a high temperature infrared wavelength transparent tube, such as for example, a high temperature quartz tube (not shown). The quartz tube may be clear or may have some form of coating and/or surface preparation to pass substantially only the desired infrared wavelengths, e.g., the quartz tube may be frosted, chemically etched, or have extruded grooves therein depending upon the desired infrared wavelength to be emitted therethrough. Tungsten may be used for the filament when enclosed in a sealed tube. The top IR heater 102 may consume from about 900 to 1000 watts of power, and the bottom IR heaters 104 and 106 may consume from about 500 to 600 watts of power, for a total power consumption of approximately 1500 to 1600 watts, well within the rating of a standard 20 ampere, 120 volt wall receptacle in a home or business, e.g., kitchen receptacle. It is contemplated and within the scope of this disclosure that other operating voltages and currents may be used so long as the desired infrared wavelengths of radiant heat energy are produced.

It is contemplated and within the scope of this disclosure that the aforementioned top IR heater may be located on one side of the food being cooked and/or reheated and the bottom IR heater may be located on another side of the food being cooked and/or reheated (not shown).

The housing 120 may be metal or non-metallic, e.g., plastic, fiberglass, etc, or some combination of both. The housing 120 is open at the front so that the food may be inserted into the oven chamber 112 when the door 122 is open. An oven control panel, e.g., intelligent user interface 118 (FIG. 6), comprises controls for the oven 100 and may be attached on or to the housing 120. A gold coating (not shown) may be applied to the quartz glass tubes for reflecting the infrared wavelength energy away from the portions of the quartz glass tubes that do not substantially contribute to the radiant heating and browning of the food. The gold coating may help in reducing the surface temperature of the housing 120. In addition, an air space between the housing 120 and the reflectors 108 and 110 also aid in reducing the surface temperature of the housing 120 during cooking and/or reheating of the food.

Referring now to FIG. 3, depicted is a schematic electrical block diagram of a multi-purpose infrared oven having an intelligent user interface, according to an example embodiment of this disclosure. Power may be applied to the top IR heater 102 through power switch 312, to the bottom IR heater 104 through power switch 306, and to the bottom IR heater 106 through power switch 310. The power switches 306, 310 and 312 may be controlled with a digital processor 302, e.g., microprocessor, microcontroller, application specific integrated circuit (ASIC), field programmable gate array (FPGA), etc. The digital processor 302 may receive input information from a door interlock 308, and the intelligent user interface 118. The door interlock 308 indicates when the door 122 is open and/or closed. The intelligent user interface 118 allows interaction with a user of the oven 100. The digital processor 302 may be programmed with predetermined routines for optimal cooking of various types of foods, e.g., steak, hamburger, pizza, pasta, dinner rolls, bread, toast, cookies, pies, turkey, chicken, pot roast, pork, tofu, meatloaf, vegetables, pastries, etc. The digital processor 302 may independently control each of the IR heaters 102, 104 and 106 for any combination of heating, cooking, browning, toasting, baking, broiling, defrosting, etc., desired. The digital processor 302 may also control a rotisserie motor 314 through a power switch 316. The rotisserie motor 316 may be controlled according to appropriate routines for rotisserie cooked foods.

Figure 4:
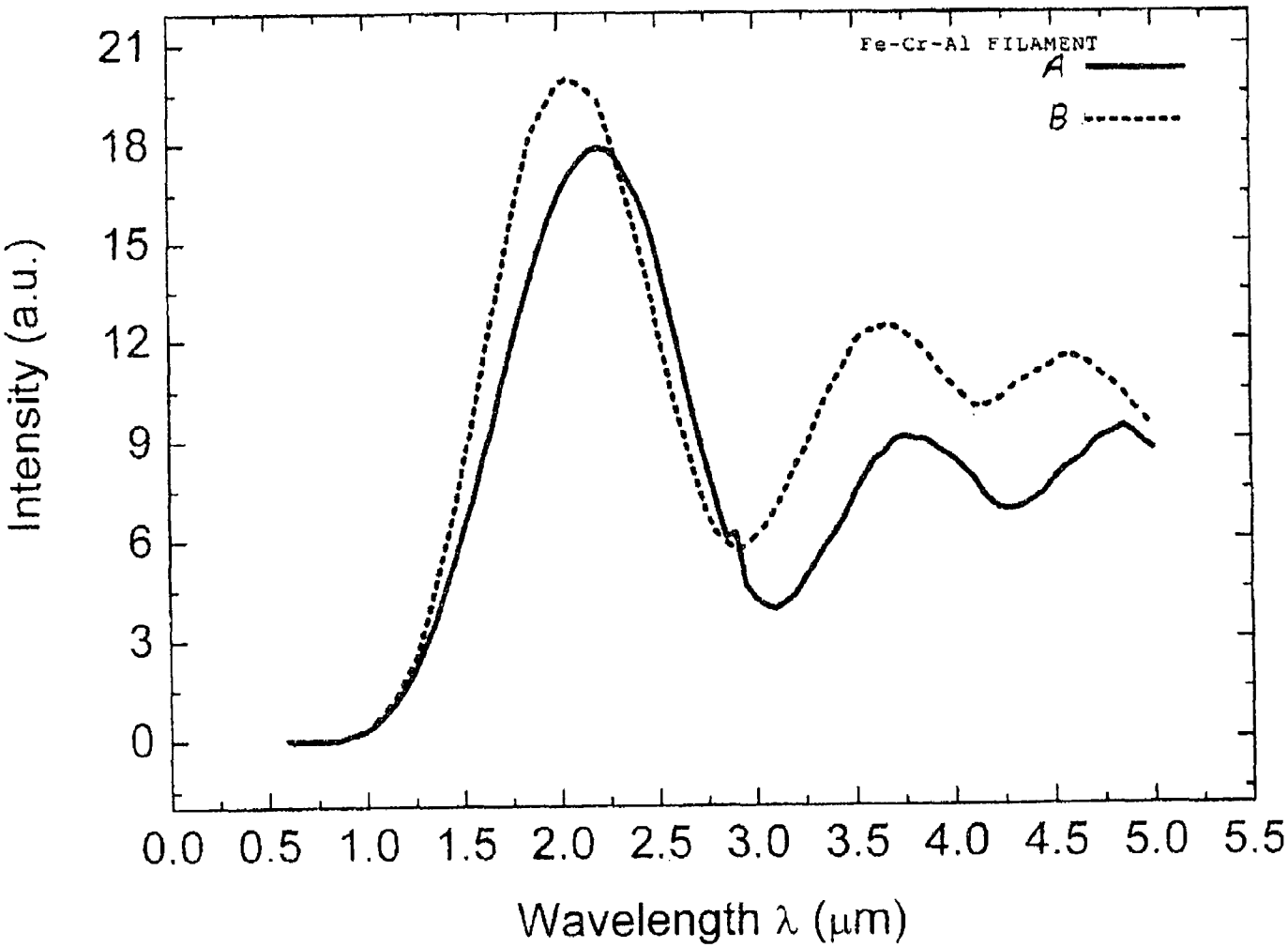
FIG. 4 is a graph of relative radiant intensity (a.u.) plotted as a function of wavelength of representative filaments that may be used for the bottom infrared heaters, according to an example embodiment of this disclosure.

Referring to FIG. 4, depicted is a graph of relative radiant intensity (a.u.) plotted as a function of wavelength of representative filaments that may be used for the bottom infrared (IR) heaters 104 and 106, according to an example embodiment of this disclosure. In this example embodiment, the filament of each of the bottom infrared heaters 104 and 106 is preferably made of Fe Cr Al, where Fe represents iron, Cr represents chromium, and Al represents aluminum. The vertical axis of the graph depicts the relative radiant intensity (a.u.) and the horizontal axis depict the wavelength relative to the vertical axis intensity. Curve A represents a first sample of a filament tested and curve B represents a second sample of another filament tested. The curves generally indicate a peak emission at about 2 microns (2000 nm). The first and second sample filaments each drew about 250 watts of power at about 120 volts.

Figure 5:
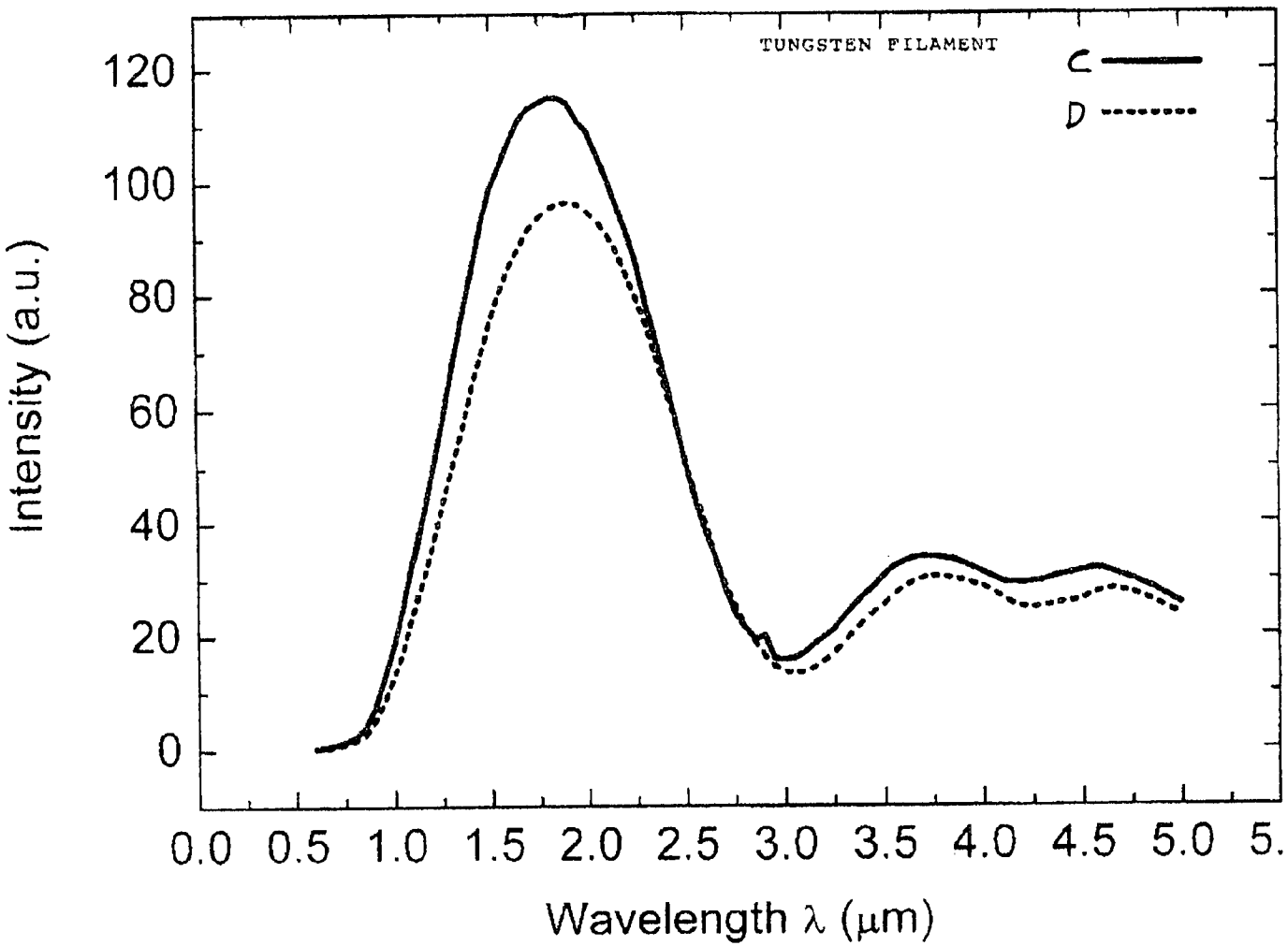
FIG. 5 is a graph of relative radiant intensity (a.u.) plotted as a function of wavelength of representative filaments that may be used for the top infrared heater, according to an example embodiment of this disclosure.

Referring to FIG. 5, depicted is a graph of relative radiant intensity (a.u.) plotted as a function of wavelength of representative filaments that may be used for the top infrared (IR) heater 102, according to an example embodiment of this disclosure. According to this example embodiment, the filament of the top IR heater 102 is preferably made of tungsten. The vertical axis of the graph depicts the relative radiant intensity (a.u.) and the horizontal axis depict the wavelength relative to the vertical axis intensity. Curve C represents a first sample of a tungsten filament tested and curve D represents a second sample of another tungsten filament tested. The curves generally indicate a peak emission at about 1.65 microns (1650 nm). The sample tungsten filaments each drew about 1000 watts of power at about 120 volts.

Figure 6:
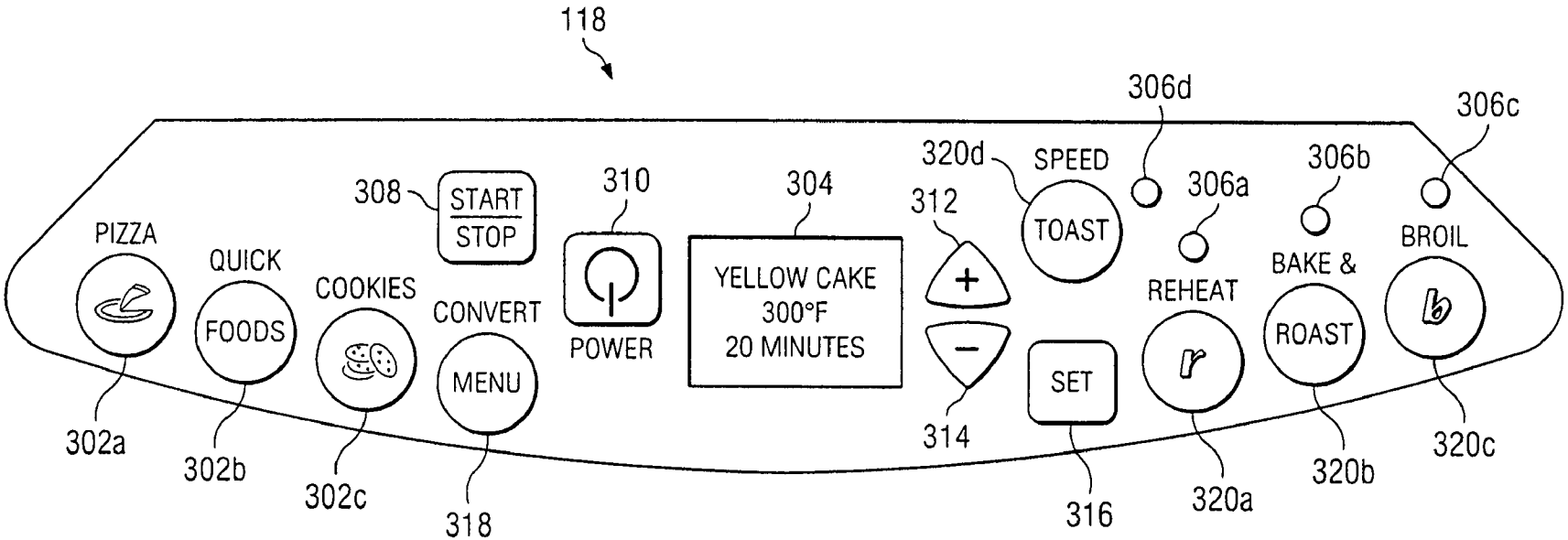
FIG. 6 is a schematic elevational view of an intelligent user interface, according to an example embodiment of this disclosure.

Referring now to FIG. 6, depicted is a schematic elevational view of an intelligent user interface, according to an example embodiment of this disclosure. The intelligent user interface, generally represented by the numeral 118, may comprise a plurality of control buttons 302, 308, 310, 312, 314 316, 318 and 320, and a display 304. Control buttons 302 may be used for quick selection of cooking profile parameters for popular foods, e.g., pizza 302*a*, quick foods 302*b*, cookies 302*c*, etc. Oven control function buttons 320 may be implemented, e.g., reheat 320*a*, bake/roast 320*b*, broil 320*c* and speed toast 320*d*. Optionally, lights 306 may be used to indicate which mode the infrared oven is operating in, e.g., reheat 306*a*, bake/roast 306*b*, broil 306*c*, or speed toast 306*d*. The display 304 also may be used to indicate the cooking mode. Cooking temperature and time may be input by pushing the set button 316, pushing the (+) button 312 to increase the parameter value or pushing the (−) button 314 to decrease the parameter value. The set button 316 also may be used to step through various cooking parameters, e.g., temperature and time that may be indicated on the display 304.

A power on-off button 310 may be used to turn on and off the infrared multi-purpose oven, e.g., oven 100. A start-stop button 308 may be used to start or stop cooking of the food. A menu button 318 may be used to select from a plurality of different foods that may have cooking profiles already defined when using the infrared multi-purpose oven. The menu button 318 may be pressed and a list of foods, indicated on the display 304, and may be scrolled through with the (+) button 312 and the (−) button 314. In addition, the menu button 318 may be used to select a convert menu for determining a cooking profile of a food not on the menu list. The convert menu can may be used to input cooking parameters of standard old technology cooking and convert these parameters into appropriate parameters so that the infrared multi-purpose oven may cook the desired food to the same expected end result.

Referring to FIGS. 7, 8A and 8B, depicted are tables of cooking parameters of an intelligent user interface for a multi-purpose oven using infrared heating in the preparation of foods, according to an example embodiment of this disclosure. The button choices depicted in the tables of FIGS. 7, 8A and 8B may be selected through a menu on the display 304, wherein cycle times for the top IR heater 102 and bottom IR heaters 104 and 106 (FIG. 1) and the default duration time in minutes for the heater cycles are programmed as the cooking profile for the selected food to be cooked.

In FIGS. 8A and 8B, the convert menu button may initiate calculation of a cooking profile for the infrared multi-purpose oven by converting standard cooking package times and temperatures to appropriate times and temperatures using the infrared multi-purpose oven for proper cooking of the food. For example: the correct meat cooking time may be converted to the infrared multi-purpose oven cooking time by taking the conventional recommended cooking time, e.g., package time, multiplying by 0.51, adding 2 minutes then adjusting the time by a factor "A" correlated to the conventional recommended cooking temperature. Fish, poultry, deserts, baked goods and casseroles may be converted in a similar fashion as shown in FIG. 7. Speed toasting may be performed for a desired toasting color with time compensation for whether the infrared multi-purpose oven is toasting from a cold or warm start.

While embodiments of this disclosure have been depicted, described, and are defined by reference to example embodiments of the disclosure, such references do not imply a limitation on the disclosure, and no such limitation is to be inferred. The subject matter disclosed is capable of considerable modification, alteration, and equivalents in form and function, as will occur to those ordinarily skilled in the pertinent art and having the benefit of this disclosure. The depicted and described embodiments of this disclosure are examples only, and are not exhaustive of the scope of the disclosure.

What is claimed is:

1. An infrared oven having an intelligent user interface, comprising:

an oven housing;

an oven chamber adapted for receiving a food, the oven chamber located within the oven housing;

at least one first infrared heater located inside of the oven chamber and positioned to be on one side of the food;

at least one second infrared heater located inside of the oven chamber and positioned to be on another side of the food, wherein the infrared heaters emit radiant heat at infrared wavelengths selected from the range of about 1 to not greater than about 3 microns for cooking the food; and an intelligent user interface for controlling the at least one first and the at least one second infrared heaters, wherein the intelligent user interface has a plurality of selectable predefined food cooking profiles and a convert-menu for receiving conventional cooking parameters from a user, including the food type, a conventional cooking time, and a conventional cooking temperature, and converting the conventional cooking parameters into an infrared cooking time using the algorithm:

$$\text{infrared cooking time}=(X+Y)*A,$$

wherein X is based on the conventional cooking time, Y is based on the food type, and A is based on the conventional cooking temperature.

2. The infrared oven according to claim 1, wherein the intelligent user interface comprises:

a display screen for displaying the plurality of predefined food cooking profiles; and at least one control switch for selecting a desired predefined food cooking profile from the plurality of predefined food cooking profiles.

3. The infrared oven according to claim 2, wherein operation of the at least one first and the at least one second infrared heaters are determined by the selected desired predefined food cooking profile.

4. The infrared oven according to claim 2, wherein each of the plurality of predefined food cooking profiles is indicated on the display screen by scrolling through a list of the plurality of predefined food cooking profiles.

5. The infrared oven according to claim 4, wherein up and down control switches are used for scrolling through the list of the plurality of predefined food cooking profiles.

6. The infrared oven according to claim 2, wherein heating modes are selected with the control switches.

7. The infrared oven according to claim 6, wherein the selected heating mode is indicated with a light.

8. The infrared oven according to claim 7, wherein the cooking modes are selected from the group consisting of quick foods, cookies, pizza, reheat, bake-roast, broil, convert-menu and toast.

9. The infrared oven according to claim 8, wherein a quick foods control switch initiates a menu of a plurality of quick foods cooking profiles to be displayed and then selects a one of the plurality of quick foods cooking profiles.

10. The infrared oven according to claim 9, wherein the plurality of quick foods cooking profiles are selected from the group consisting of chicken nuggets, pizza rolls, potato skins, poppers, chicken wings, bagel bites, potato crispers and oven fries.

11. The infrared oven according to claim 10, wherein the plurality of quick foods cooking profiles include a plurality of frozen quick foods cooking profiles.

12. The infrared oven according to claim 9, wherein a cookies control switch initiates a cookie cooking profile for controlling the oven.

13. The infrared oven according to claim 9, wherein a pizza control switch initiates a menu of a plurality of pizza cooking profiles to be displayed and then selects a one of the plurality of pizza cooking profiles.

14. The infrared oven according to claim 13, wherein the plurality of pizza cooking profiles are selected from the group consisting of regular pizza, rising crust pizza, French bread, fresh pizza, homemade pizza and deli pizza.

15. The infrared oven according to claim 9, wherein a reheat control switch initiates a menu of a plurality of reheat cooking profiles to be displayed and then selects a one of the plurality of reheat cooking profiles.

16. The infrared oven according to claim 15, wherein the plurality of reheat cooking profiles are selected from the group consisting of a pizza slice, a plurality of pizza slices, ribs, chicken pieces and a casserole.

17. The infrared oven according to claim 9, wherein a bake-roast control switch initiates a menu of a plurality of bake-roast cooking profiles to be displayed and then selects one of the plurality of bake-roast cooking profiles.

18. The infrared oven according to claim 17, wherein the plurality of bake-roast cooking profiles are selected from the group consisting of a yellow layer cake, chocolate layer cake, yellow cupcakes, muffins, coffee cake, brownies, bar cookies, baked potatoes, single crust pie, refrigerator biscuits, homemade biscuits, refrigerator crescent rolls, frozen biscuits, casserole, lasagna, chicken, turkey, meat loaf, beef, and rib roast.

19. The infrared oven according to claim 18, wherein the chicken bake-roast cooking profile is selected from the group consisting of whole chicken, chicken parts and chicken breast.

20. The infrared oven according to claim 18, wherein the turkey bake-roast cooking profile is selected from the group consisting of half turkey breast and frozen turkey breast roll.

21. The infrared oven according to claim 8, wherein a broil control switch initiates a menu of a plurality of broil cooking profiles to be displayed and then selects a one of the plurality of broil cooking profiles.

22. The infrared oven according to claim 21, wherein the plurality of broil cooking profiles are selected from the group consisting of high broil and low broil.

23. The infrared oven according to claim 22, wherein the high broil cooking profile is selected from the group consisting of pork loin, rib chop, beef steak, hot dog, fresh hamburger, frozen hamburger, beef hamburger, turkey hamburger and vegetable hamburger.

24. The infrared oven according to claim 22, wherein the low broil cooking profile is for chicken parts.

25. The infrared oven according to claim 8, wherein a toast switch initiates menu of a plurality of toast cooking profiles to be displayed and then selects a one of the plurality of toast cooking profiles.

26. The infrared oven according to claim 6, wherein a convert-menu switch initiates a menu of a plurality of selectable food types.

27. The infrared oven according to claim 26, wherein at least one of the plurality of food types is selected from the group consisting of meat, fish, poultry, dessert, baked goods and casserole.

28. The infrared oven according to claim 26, wherein for a food cooking profile for a selected one of the plurality of food types the infrared oven converts cooking time and temperature to at least one on time for at least one of the at least one first and the at least one second infrared heaters.

29. The infrared oven according to claim 28, further comprising using weight of a food to convert the cooking time and temperature to appropriate on times of the at least one first and the at least one second infrared heaters.

30. The infrared oven according to claim 28, further comprising using thickness of a food to convert the cooking time and temperature to appropriate on times of the at least one first and the at least one second infrared heaters.

31. An infrared oven comprising:

an oven chamber adapted for receiving a food;

at least one first infrared heater located inside of the oven chamber and positioned to be on one side of the food;

at least one second infrared heater located inside of the oven chamber and positioned to be on another side of the food; and a convert-menu for receiving conventional cooking parameters from a user, including the food type, a conventional cooking time, and a conventional cooking temperature, and converting the conventional cooking parameters into an infrared cooking time using the algorithm:

$$\text{infrared cooking time}=(X+Y)*A,$$

wherein X is based on the conventional cooking time, Y is based on the food type, and A is based on the conventional cooking temperature.

32. The infrared oven according to claim 31, wherein the at least one first infrared heater emits radiant heat at an infrared wavelength selected from the range of about 1.6 to about 1.7 microns.

33. The infrared oven according to claim 31, wherein the at least one second infrared heater emits radiant heat at an infrared wavelength selected from the range of about 2 to about 2.2 microns.

34. The infrared oven according to claim 31, wherein the at least one first infrared heater emits radiant heat at an infrared wavelength of about 1.6 micron.

35. The infrared oven according to claim 31, wherein the at least one second infrared heater emits radiant heat at an infrared wavelength of about 2.1 micron.

36. The infrared oven according to claim 32, wherein the at least one first infrared heater is located on a top side of the food.

37. The infrared oven according to claim 33, wherein the at least one second infrared heater is located on a bottom side of the food.

38. The infrared oven according to claim 34, wherein the at least one first infrared heater is located on a top side of the food.

39. The infrared oven according to claim 35, wherein the at least one second infrared heater is located on a bottom side of the food.

40. The infrared oven according to claim 31, wherein the at least one first infrared heater emits radiant heat at an infrared wavelength selected from the range of about 1.6 to about 1.7 microns, and the at least second infrared heater emits radiant heat at an infrared wavelength selected from the range of about 2 to about 2.2 microns.

41. The infrared oven according to claim 40, wherein the at least one first infrared heater is located on a top side of the food, and the at least one second infrared heater is located on a bottom side of the food.

42. The infrared oven according to claim 31, wherein the at least one first infrared heater emits radiant heat at an infrared wavelength of about 1.6 micron, and the at least second infrared heater emits radiant heat at an infrared wavelength of about 2.1 micron.

43. The infrared oven according to claim 42, wherein the at least one first infrared heater is located on a top side of the food, and the at least one second infrared heater is located on a bottom side of the food.

44. The infrared oven according to claim 31, wherein another infrared heater is located inside the oven chamber and is positioned to be on one side of the food.

45. The infrared oven according to claim 44, wherein the another infrared heater is positioned on a bottom side of the food.

46. The infrared oven according to claim 31, wherein intermittent operation of the at least one first and the at least one second infrared heaters is determined by user-provided information for the food cooking profile.

47. The infrared oven according to claim 31, wherein an operating profile of on times for the at least one first infrared heater is determined using the food cooking profile time and temperature information.

48. The infrared oven according to claim 47, wherein an operating profile of on times for the at least one second infrared heater is determined using the food cooking profile time and temperature information.

49. The infrared oven according to claim 31, wherein the infrared oven includes a rotisserie.

50. The infrared oven according to claim 31, wherein the convert-menu prompts for information.

* * * * *